United States Patent [19]

Slafer et al.

[11] Patent Number: 4,663,274

[45] Date of Patent: May 5, 1987

[54] METHOD FOR FORMING A PHOTOSENSITIVE SILVER HALIDE ELEMENT

[75] Inventors: Warren D. Slafer, Arlington; Vivian K. Walworth, Concord, both of Mass.

[73] Assignee: Polaroid Corporation, Cambridge, Mass.

[21] Appl. No.: 718,698

[22] Filed: Apr. 1, 1985

[51] Int. Cl.[4] ..... G03C 1/02

[52] U.S. Cl. ..... 430/567; 430/568; 430/569; 430/935

[58] Field of Search ..... 430/494, 422, 567, 568, 430/569, 603, 935

[56] References Cited

U.S. PATENT DOCUMENTS

| | | | |
|---|---|---|---|
| 2,449,153 | 9/1948 | Urbach | 430/603 |
| 2,632,704 | 3/1953 | Lowe et al. | 430/569 |
| 2,740,713 | 4/1956 | Warren | 430/422 |
| 3,085,897 | 4/1963 | Priest et al. | 430/935 |
| 4,352,874 | 10/1982 | Land et al. | 430/567 |
| 4,356,257 | 10/1982 | Gerber | 430/567 |
| 4,359,526 | 11/1982 | Walworth | 430/567 |

OTHER PUBLICATIONS

Duffin, G. F., Photographic Emulsion Chemistry, 1966, p. 69.

*Primary Examiner*—Mary F. Downey

[57] ABSTRACT

A method for forming photosensitive silver halide grains which comprises coalescing a fine-grain silver halide emulsion layer carried on a substantially planar surface of a support.

7 Claims, 10 Drawing Figures

METHOD FOR FORMING A PHOTOSENSITIVE SILVER HALIDE ELEMENT

BACKGROUND OF THE INVENTION

In the formation of photosensitive silver halide emulsions, the physical ripening or growing step during which time the silver halide grains increase in size is considered important. During the ripening stage an adequate concentration of a silver halide solvent, for example, excess halide, generally bromide, is employed which renders the silver halide much more soluble than it is in pure water because of the formation of complex ions. This facilitates the growth of the silver halide grains. While excess bromide and ammonia are the most common ripening agents, the literature also mentions the use of water-soluble thiocyanate compounds as well as a variety of amines in place of bromide. See, for example, Photographic Emulsion Chemistry, G. F. Duffin, The Focal Press London, 1966, page 59.

U.S. Pat. No. 4,356,257, issued Oct. 26, 1982, is directed to a method for forming a photosensitive element comprising a plurality of single effective silver halide grains, which method comprises coalescing fine-grain silver halide in a plurality of predetermined spaced depressions. Preferably, the coalescence is effected by contacting fine-grain silver halide with a solution of a silver halide solvent.

U.S. Pat. No. 4,352,874, issued Oct. 5, 1982, is directed to a method of forming a photosensitive element comprising a plurality of single effective silver halide grains, which method comprises coalescing a fine-grain emulsion in a plurality of predetermined spaced depressions by contacting said fine-grain emulsion with a solution of a silver halide solvent containing a dissolved silver salt.

U.S. Pat. No. 4,359,526, issued Nov. 16, 1982, is directed to a method for forming a photosensitive element comprising a plurality of single effective grains in a predetermined spaced array which comprised coalescing a fine grain silver halide emulsion in a plurality of predetermined spaced depressions in a surface, wherein said coalescence is carried out by contacting said fine-grain emulsion with a silver halide solvent in the vapor phase.

SUMMARY OF THE INVENTION

The present invention is directed to a method for forming photosensitive silver halide grains which comprise coalescing a fine-grain silver halide emulsion carried on a substantially planar surface of a support.

DETAILED DESCRIPTION OF THE INVENTION

Figure 1A:
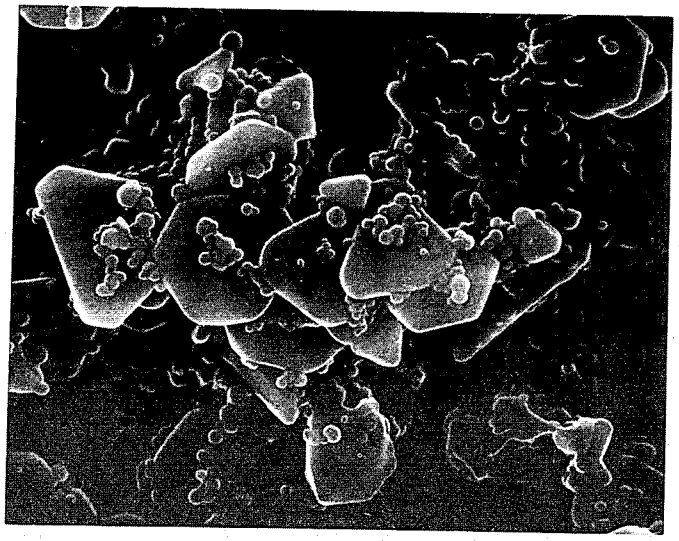
FIG. 1A is a secondary electron micrograph at 10,000X magnification of silver halide grains prepared by the method of Example 1.

The present invention is directed to a method wherein coalescence of a fine-grain silver halide emulsion is carried out on a substantially planar surface of a support in contradistinction to the coalescence methods described in U.S. Pat. Nos. 4,356,257 and 4,352,874 wherein a plurality of spaced depressions are employed to carry the fine-grain silver halide, and in which depressions coalescence occurs. By means of the present invention, greater variety in the type and character of silver halide grains is achieved.

In the present invention, a fine-grain silver halide emulsion is coated on a planar surface of a support and then coalescence is carried out while a cover is superimposed over the layer of silver halide emulsion. While the cover is not necessary, carrying out the coalescence in a confined environment minimizes loss of solvent by evaporation. Upon removal of the cover, an increase in grain size is noted. Preferably, coalescence is carried out by laminating a support carrying a fine-grain silver halide emulsion layer to a suitable cover during the application of a coalescing solution. More preferably, the laminate is heated to accelerate coalescence.

The term "planar surface", as used herein, is intended to refer to a smooth surface devoid of a relief pattern of depressions or pores.

The term "fine grain", as used herein, is intended to refer to a silver halide emulsion containing grains between about 0.01 and 0.05 micrometers in diameter. Particularly preferred is a silver halide emulsion having a grain size with an average diameter of about 0.1 micrometers or less.

The term "cover" as used herein is intended to include any suitable means for confining the silver halide emulsion and coalescing solution during coalescence and includes sheets, rollers, drums, platens and the like. For a continuous operation, a belt or roller or drum configuration is useful. Preferably, the cover employed is more hydrophobic than the surface carrying the fine-grain silver halide emulsion to prevent any grains or gelatin from adhering to the cover when the cover is removed.

The binder to silver ratio of the emulsions employed in the present invention may be varied over a relatively wide range. Preferably, the gel to silver ratio ranges from about 0.05:1 to 1:1.

It is also preferred that surfactants be employed to facilitate coating of the fine-grain emulsion on the support. In a preferred embodiment, the surfactants comprise a combination of AEROSOL OT (dioctyl ester of sodium sulfosuccinic acid) American Cyanamid Co., Wayne, N.J. and MIRANOL J2M-SF (dicarboxylic caprylic derivative sodium salt) Miranol Chemical Co., Inc., Irvington, N.J., in a 1 to 3 ratio by weight, respectively, at about 0.1% concentration by weight, based on the weight of the emulsion.

The term "coalescence" is used herein in the broad sense and is intended to include both Ostwald ripening and coalescence ripening.

Any suitable silver halide solvent known to the art and combinations thereof may be employed in the practice of the present invention as the coalescing solution. As examples of such solvents mention may be made of the following: soluble halide salts, e.g., lithium bromide, potassium bromide, lithium chloride, potassium chloride, sodium bromide, sodium chloride; sodium thiosulfate, sodium sulfate, ammonium thiocyanate, potassium thiocyanate, sodium thiocyanate; thioethers such as thiodiethanol; ammonium hydroxide, organic silver complexing agents, such as ethylene diamine and higher amines. In a preferred embodiment, a combination of potassium bromide and ammonium thiocyanate is employed.

The silver halide solvent solution may also contain chemical sensitizers, for example, in the form of soluble gold and sulfur compounds. Still further, the above-described silver salts added to the coalescing solution could be chemically sensitized silver halide.

For ease of application, a small amount of polymeric binder material, such as gelatin or hydroxyethyl cellulose may be employed in the coalescing solution of silver halide solvent. Suitable amounts of binder range up to about 10% by weight based on the weight of the solution. The coalescing solution can be applied to the fine-grain emulsion by any suitable means, including flowing, spraying, slot-coating and the like.

By employing a less soluble halide in the coalescing solution, a mixed halide grain can be produced during the coalescence. For example, if silver bromide constituted the silver halide coated on a support and the coalescing solution included a soluble iodide salt, a silver iodobromide grain would be obtained.

Preferably, spectral sensitization of the photosensitive elements of the present invention may be achieved by applying a solution of a spectral sensitizing dye to the thus-formed silver halide grains. This is accomplished by applying a solution of a desired spectral sensitizing dye to the grains subsequent to coalescence. However, the sensitizing dye may be added at any suitable point during the process.

In one embodiment, the cover has a substantially planar surface. If the gel to silver ratio of the coated emulsion were in the "lower" portion of the range, i.e., about 0.05:1 to 0.1:1, then the coalescence would produce grains having a variety of morphologies and a random spatial distribution on the support. If the gel to silver ratio of the coated fine grain emulsion were in the "higher" range, i.e., about 0.2:1 to 1:1, then the coalesced grains would be predominently platelet in character and random in spatial distribution on the support.

In a particularly preferred embodiment, the cover contains a planar surface containing a plurality of regularly spaced depressions therein. Thus, any of the covers described above may be employed in this embodiment if they are provided with the described patterned surface. Upon coalescence, the grains are found to be distributed in a predetermined spatial array on the original planar support substantially corresponding to the pattern of depressions on the cover. The type of grain produced by this method is also influenced by the gel to silver ratio of the fine-grain emulsion. If the gel to silver ratio is in the "lower" range, i.e., 0.05:1 to 0.1:1, then the grains produced by coalescence are substantially spherical with a surface having an appearance of nubs, i.e., mulberry-like. If the gel to silver ratio is in the "higher" range, i.e., about 0.2:1 to 1:1 then the grains are platelet in character as well as arrayed on the support.

Another factor influencing grain morphology and size in the presence or absence of a cover as well as the size of the gap employed in a lamination step. Thus, without a cover, e.g., wherein the coalescing fluid is just metered onto the fine-grain emulsion, it is only necessary that the coalescing fluid permeate the emulsion layer. Alternatively, a cover may be laminated over the layer of fine-grain emulsion with a specified gap, e.g., 0.0001 in. to 0.010 in. In another embodiment, the cover may be laminated to the fine-grain emulsion with a zero gap. Conveniently, the coalescing fluid is applied to the nip in the lamination operations.

In a particularly preferred embodiment, a cover is first laminated at a specified gap to provide an imbibition period allowing the emulsion to effectively take up the coalescing fluid, followed by a zero gap lamination which serves to expel excess fluid and, particularly in the case of high gel to silver ratio fine-grain emulsions, prevents the coalesced grains from wandering.

The following non-limiting examples illustrate the novel method of the present invention.

EXAMPLE 1

Figure 1B:
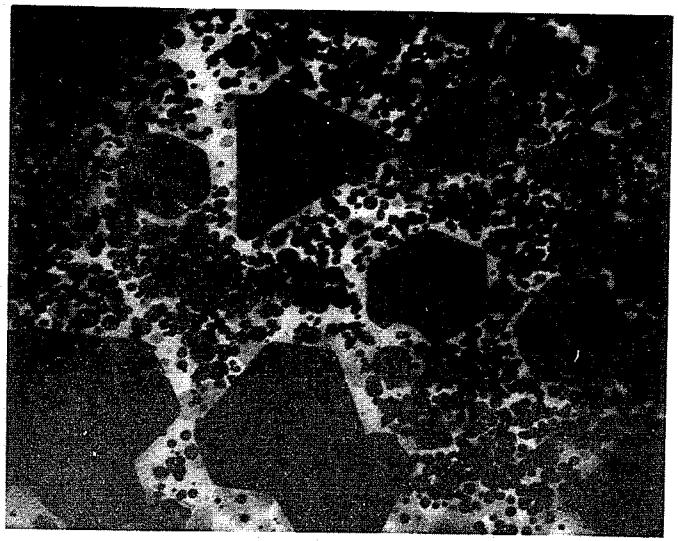
FIG. 1B is a scanning electron micrograph at 10,000X magnification of silver halide grains prepared by the method of Example 1.

A fine-grain silver bromide emulsion (gelatin/Ag ratio of 0.50, 0.1 micrometer average grain diameter), 0.1% succindialdehyde, and a 1 to 3 ratio by weight of AEROSOL OT and MIRANOL J2M-SF, respectively, at a 1% concentraton by weight, was coated on a 3 mil cellulose triacetate support at a silver coverage of 78 mg/ft$^2$. After drying, the silver halide layer was overlaid with a cover sheet consisting of a 3 mil polyester base carrying a 0.5 mil layer of cellulose acetate butyrate (CAB) and passed between stainless steel rollers (0.002 in. gap) at 15 feet per minute while a silver halide solvent solution was applied to the nip formed by the emulsion-coated support and the CAB surface of the cover sheet. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi, 15 feet per minute). The laminate was heated on a stainless steel drum at 70° C. for 15 sec., allowed to cool for 10 sec. and then the cover sheet was removed. The support carried platelet grains. FIG. 1A is a secondary electron micrograph at 10,000X magnification showing the layer of coalesced silver halide grains. FIG. 1B is a scanning transmission electron micrograph at 10,000X magnification showing the layer of coalesced grains. It will be seen that the support carries a mixture of larger platelets and very small grains which have not grown much from the original grain size.

EXAMPLE 2

Figure 2A:
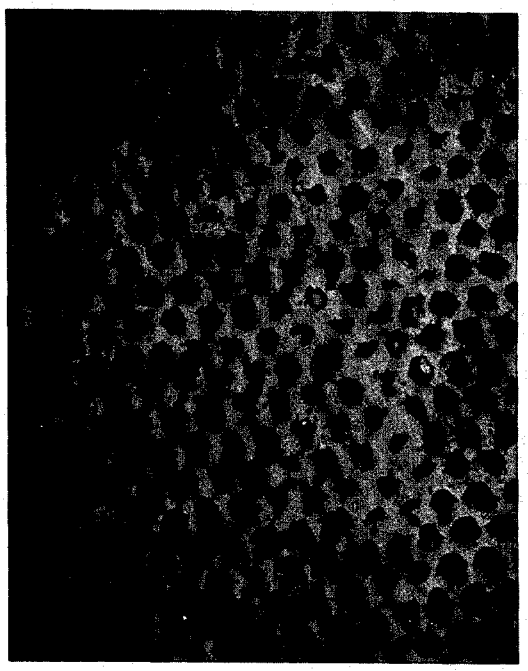
FIG. 2A is a scanning transmission electron micrograph at 2,000X magnification of silver halide grains prepared by the method of Example 2.
Figure 2B:
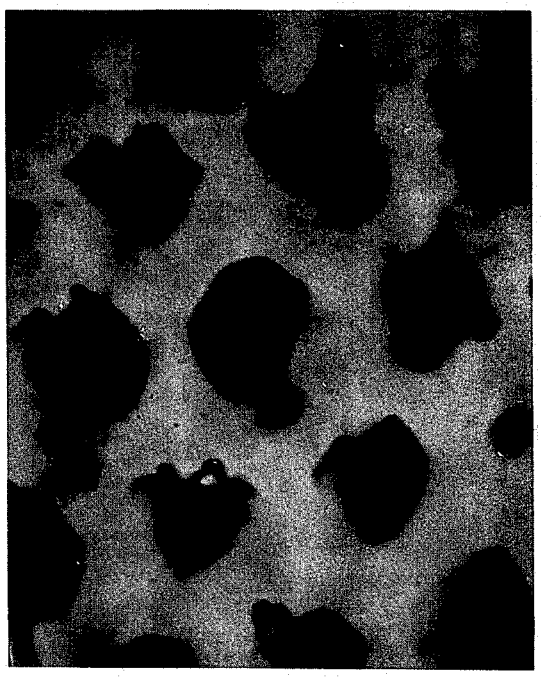
FIG. 2B is a scanning transmission electron micrograph at 10,000X magnification of silver halide grains prepared by the method of Example 2.

A fine-grain silver bromide emulsion (gelatin/silver ratio 0.25, average grain diameter of 0.1 micrometer), 0.1% succindialdehyde, and 1 to 3 ratio by weight of AEROSOL OT and MIRANOL J2M-SF, respectively at about 1% concentration by weight, was coated on a 3 mil cellulose triacetate support at a silver coverage of about 40 mg/ft$^2$. After drying, the silver halide layer was laminated to a cover sheet comprising a polyester base carrying a 0.5 mil layer of a cellulose acetate butyrate embossed with a 2.5 micrometer (center-to-center) array of 1.5 micrometer deep hexagonal depressions by means of stainless steel rollers (0.002 in. gap) at 15 feet per minute while a silver halide solvent solution was applied to the nip. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi at 15 feet per minute). The laminate was heated on a stainless steel drum at 90° C. for 15 sec. allowed to cool for 10 sec. and the cover sheet removed. A diffraction pattern was observed, indicative of an arrayed structure on the support. FIGS. 2A and 2B are scanning transmission electron micrographs at 2,000X and 10,000X magnification, respectively, showing the pattern of arrayed grains on the support.

EXAMPLE 3

Figure 3A:
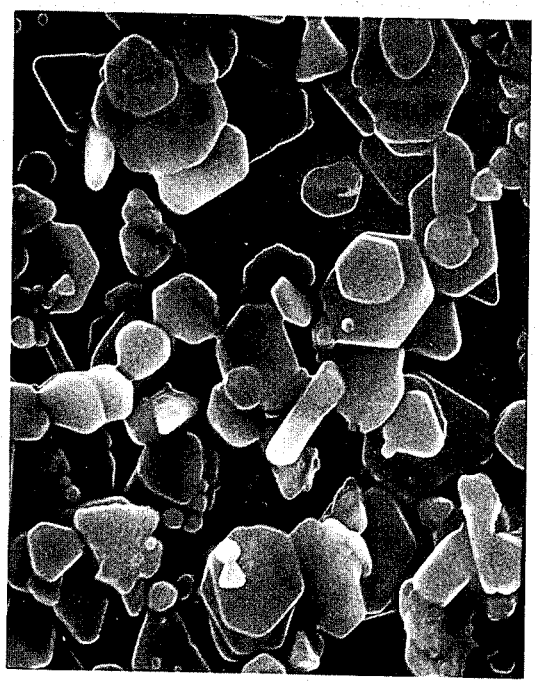
FIG. 3A is a secondary electron micrograph at 5,000X magnification of silver halide grains prepared by the method of Example 3.
Figure 3B:
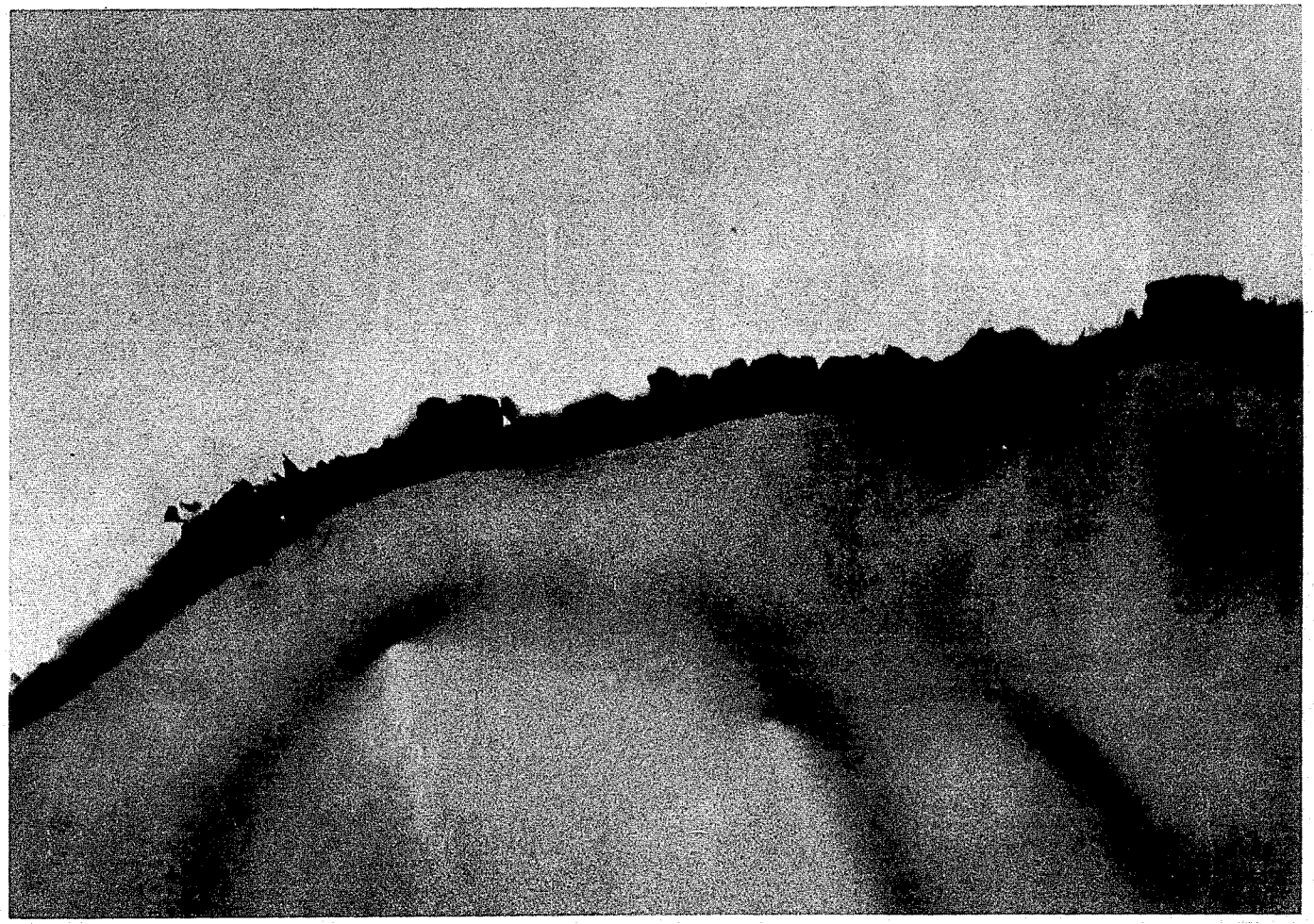
FIG. 3B is a scanning transmission electron micrograph at 10,000X magnification showing in cross section silver halide grains prepared by the method of Example 3.

A fine-grain silver bromide emulsion (gelatin/Ag ratio of 0.50, 0.1 micrometer average grain diameter), 0.1% succindialdehyde, and a 1 to 3 ratio by weight of AEROSOL OT and MIRANOL J2M-SF, respectively at a 1% concentration by weight, was coated on a 3 mil cellulose triacetate support at a silver coverage of 78 mg/ft$^2$. After drying, the silver halide layer was overlaid with a cover sheet consisting of a 3 mil polyester base carrying a 0.5 mil layer of cellulose acetate butyrate and passed between stainless steel rollers (0.002 in. gap) at 15 feet per minute while a silver halide solvent solution was applied to the nip formed by the emulsion-coated support and the CAB surface of the cover sheet. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi at 15 feet per minute). The laminate was heated on a stainless steel drum at 70° C. for 60 sec., allowed to cool for 10 sec. and then the cover sheet was removed. FIG. 3A is a secondary electron image at 5,000X magnification showing large platelet grains with very few smaller grains. FIG. 3B is an electron micrograph at 10,000X magnification showing a cross-section of the support carrying the coalesced grains. Large platelet grains are observed with very few smaller grains.

EXAMPLE 4

Figure 4A:
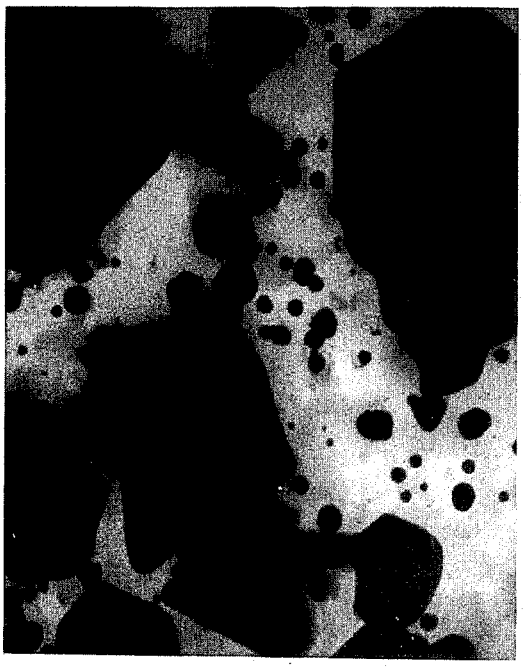
FIG. 4A is a scanning transmission electron micrograph at 10,000X magnification showing silver halide grains prepared by the method of Example 4.
Figure 4B:
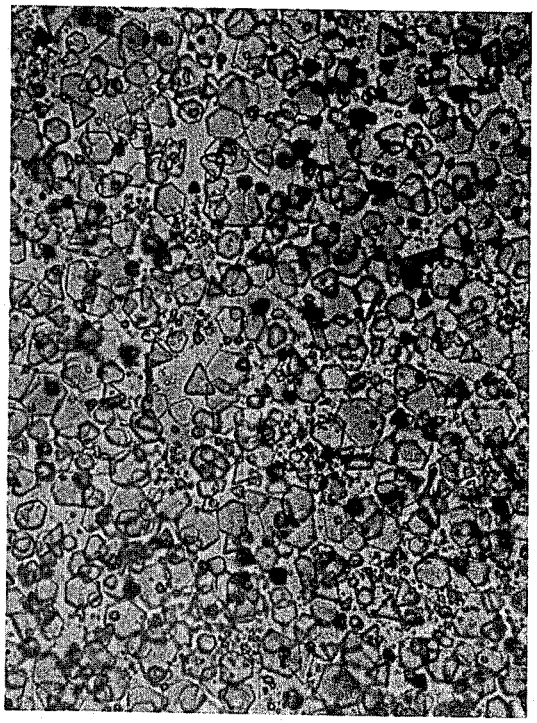
FIG. 4B is an optical micrograph at 1,600X magnification showing silver halide grains prepared by the method of Example 4.

A fine-grain silver bromide emulsion (gelatin/Ag ratio of 1.0, 0.1 micrometer average grain diameter), 0.1% succindialdehyde, and a 1 to 3 ratio by weight of AEROSOL OT and MIRANOL J2M-SF, respectively at a 1% concentration by weight, was coated on a 3 mil cellulose triacetate support at a silver coverage of 73 mg/ft$^2$. After drying, the silver halide layer was overlaid with a cover sheet consisting of a 3 mil polyester base carrying a 0.5 mil layer of cellulose acetate butyrate and passed between stainless steel rollers (0.002 in. gap) at 15 feet per minute while a silver halide solution was applied to the nip formed by the emulsion-coated support and the CAB surface of the coversheet. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi at 15 feet per minute). The laminate was heated on a stainless steel drum at 90° C. for 15 sec., allowed to cool for 10 sec. and then the cover sheet was removed. FIG. 4A is a scanning transmission electron micrograph at 10,000X mangification showing a mixture of large platelets and very small grains. FIG. 4B is an optical micrograph at 1,600X magnification showing the mixture of grains.

EXAMPLE 5

Figure 5:
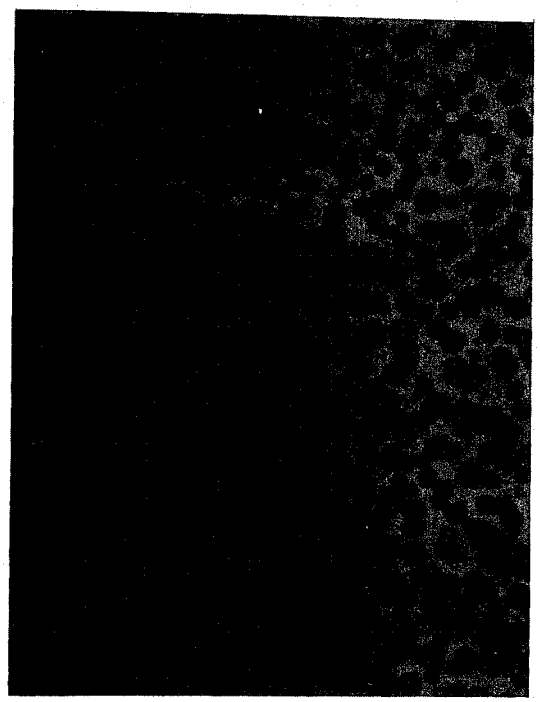
FIG. 5 is an optical micrograph at 1,600X magnification showing silver halide grains prepared by the method of Example 5.

A fine-grian silver bromide emulsion (gelatin/Ag ratio of 0.50, 0.1 micrometer average grain diameter), 0.1% succindialdehyde, and a 1 to 3 ratio by weight of AEROSOL OT and MIRANOL J2M-SF, respectively at a 1% concentration by weight, was coated on a 3 mil cellulose triacetate support at a silver coverage of 78 mg/ft$^2$. After drying, the silver halide layer was overlaid with a cover sheet consisting of a 3 mil polyester base carrying a 0.5 mil layer of cellulose acetate butyrate and passed between stainless steel rollers (0.002 in. gap) at 15 feet per minute while a silver halide solvent solution was applied to the nip formed by the emulsion-coated support and the CAB surface of the cover sheet. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi at 15 feet per minute). The laminate was heated on a stainless steel drum at 105° C. for 60 sec., allowed to cool for 10 sec. and then the cover sheet was removed. FIG. 5 is an optical micrograph at 1,600X magnification showing a narrow distribution of rounded grains, 1–2 micrometers average diameter.

EXAMPLE 6

A fine-grain silver bromide emulsion (gelatin/Ag ratio of 0.50, 0.1 micrometer average grain diameter), 0.1% succindialdehyde, and a 1 to 3 ratio by weight of AEROSOL OT and MIRANOL J2M-SF, respectively at a 1% concentration by weight, was coated on a 3 mil cellulose triacetate support at a silver coverage of 78 mg/ft$^2$. After drying, the silver halide layer was overlaid with a cover sheet consisting of a 3 mil polyester base carrying a 0.5 mil layer of cellulose acetate butyrate and passed between stainless steel rollers (0.002 in. gap) at 15 feet per minute while a silver halide solvent solution was applied to the nip formed by the emulsion-coated support and the CAB surface of the cover sheet. The silver halide solvent solution comprised 0.5% ammonium thiocyanate, 12% potassium bromide and 0.5% hydroxyethyl cellulose. The thus-formed sandwich was immediately laminated again by passing it between 1.5 in. diameter, pressure activated rubber rollers (60 durometer, with a pressure of 35 psi at 15 feet per minute). The laminate was heated on a stainless steel drum at 90°

Figure 6:
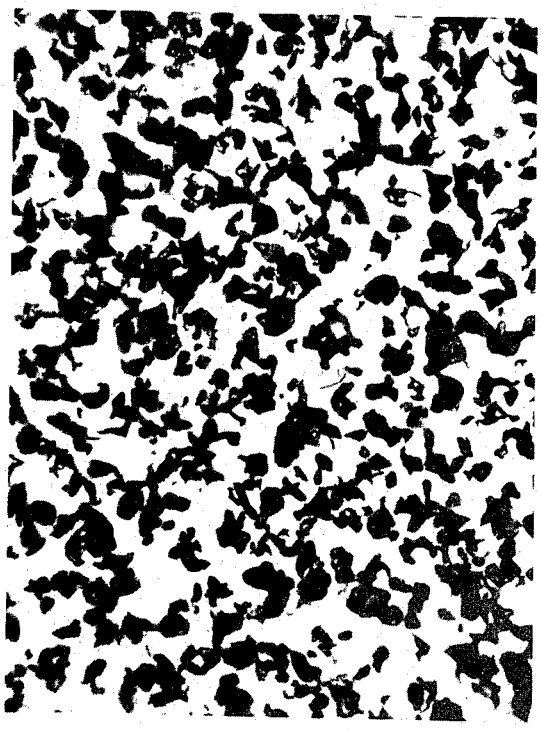
FIG. 6 is an optical micrograph at 1,000X magnification of developed silver prepared by the method of Example 6.

C. for 60 sec., allowed to cool for 10 sec. and then the cover sheet was removed. The thus-formed grains on the support were then exposed to a step tablet and continuous wedge at 2 mcs and processed with a Type 42 processing composition and Type 107c receiving sheet (Polaroid Corp., Cambridge, Mass.). A low fog level and a reasonable density scale were observed. FIG. 6 is an optical micrograph at 1,000X magnification of the $D_{max}$ showing the filamentary type developed grains.

The cover containing predetermined spaced depressions in a surface may be prepared by exposing a photoresist to interfering coherent radiation and developed to provide a relief pattern that can be replicated by techniques kown to the art. Details for forming such relief patterns are set forth in U.S. Pat. Nos. 4,402,571 issued Sept. 6, 1983 and 4,496,216, issued Jan. 29, 1985.

What is claimed is:

1. A method for forming photosensitive silver halide grains which comprises coalescing a fine-grain silver halide emulsion layer carried on a substantially planar surface of a support, said emulsion having a grain size 0.01–0.5 micrometers average diameter and a gel to silver ratio of 0.05:1 to 1:1, by laminating a cover having a substantially planar surface over said silver halide emulsion layer, applying a silver halide solvent solution to the nip formed by said support and said cover and removing said cover.

2. The method of claim 1 wherein said gel to silver ratio is about 0.05:1 to 0.1:1.

3. The method of claim 1 wherein said gel to silver ratio is about 0.2 to 1:1.

4. A method for forming photosensitive silver halide grains which comprises coalescing a layer of fine-grain silver halide emulsion caried on a substantially planar surface of a support wherein said coalescence is carried out by laminating a cover having a substantially planar surface over said silver halide emulsion layer and applying a solution of silver halide solvent to the nip formed by said cover and said layer.

5. The method of claim 4 wherein said coalescence includes the application of heat.

6. The method of claim 4 wherein said emulsion has a grain size between about 0.01 and 0.50 micrometers average diameter.

7. The method of claim 4 wherein said emulsion has a gel to silver ratio of between 0.05:1 and 1:1.

* * * * *